US006186663B1

(12) United States Patent
Ausnit

(10) Patent No.: US 6,186,663 B1
(45) Date of Patent: Feb. 13, 2001

(54) GUSSETED PACKAGE WITH RECLOSABLE ZIPPER

(75) Inventor: Steve Ausnit, New York, NY (US)

(73) Assignee: Illinois Tool Works Inc., Glenview, IL (US)

( * ) Notice: Under 35 U.S.C. 154(b), the term of this patent shall be extended for 0 days.

(21) Appl. No.: 09/375,889

(22) Filed: Aug. 17, 1999

(51) Int. Cl.[7] ..... B65D 33/16

(52) U.S. Cl. ..... 383/63; 383/64; 383/120; 383/210; 24/30.5 R; 24/559

(58) Field of Search ..... 383/43, 63, 64, 383/65, 120, 210, 211; 24/30.5 R, 559, 587, 399, 400, 430

(56) References Cited

U.S. PATENT DOCUMENTS

| | | | | |
|---|---|---|---|---|
| 4,706,297 | * | 11/1987 | Ausnit | 383/63 |
| 4,736,450 | * | 4/1988 | Van Erden et al. | 383/65 |
| 4,971,454 | * | 11/1990 | Branson et al. | 383/63 X |
| 4,997,104 | * | 3/1991 | Pohl | 383/43 X |
| 5,037,138 | * | 8/1991 | McClintock et al. | 383/43 X |
| 5,364,189 | * | 11/1994 | Kuge et al. | 383/63 X |
| 5,692,837 | * | 12/1997 | Beer | 383/20 X |
| 5,788,378 | * | 8/1998 | Thomas | 383/63 |
| 5,938,339 | * | 8/1999 | Ouchi | 383/63 |
| 6,030,123 | * | 2/2000 | Mitarai | 383/63 |
| 6,082,897 | * | 7/2000 | Galomb | 383/63 |

FOREIGN PATENT DOCUMENTS

| | | | | |
|---|---|---|---|---|
| 5-270551 | * | 10/1993 | (JP) | 383/63 |
| 5-270552 | * | 10/1993 | (JP) | 383/63 |

* cited by examiner

*Primary Examiner*—Jes F. Pascua
(74) *Attorney, Agent, or Firm*—Pitney, Hardin, Kipp & Szuch LLP

(57) ABSTRACT

A gusseted package having a reclosable zipper is provided. The package includes opposing first and second walls extending from a package bottom and joined together by a pair of opposing expanding side gussets. The package further includes a reclosable zipper attached to the package walls. The reclosable zipper includes a carrier web having opposing first and second walls joined at their ends by opposing first and second gussets and a pair of interlocking fastener profiles attached to the opposing walls. When the fastener profiles are interlocked, the first and second gussets are captured between the profiles.

18 Claims, 6 Drawing Sheets

GUSSETED PACKAGE WITH RECLOSABLE ZIPPER

BACKGROUND OF THE INVENTION

1. Field of the Invention

The present invention relates to the field of reclosable packaging. More particularly, the present invention relates to a gusseted package having a reclosable zipper.

2. Description of the Prior Art

Gusseted packages having reclosable zippers are well-known in the reclosable packaging art. For example, U.S. Pat. No. 4,736,450 discloses such a package. In a typical prior art gusseted package having a reclosable zipper, the front and back walls of the package are joined together by expanding side gussets. Interlocking reclosable zipper profiles are sealed to the front and back walls at free upper end portions of the package walls which are not joined by the gussets. This however does not provide for package integrity.

Accordingly, it is the object of the present invention to provide a new and improved gusseted package having a reclosable zipper which overcomes problems associated with the prior art as indicated above.

Alternately a reclosable zipper may be sealed to the front wall, with the gusset and front and back walls being then sealed together at the top of the package. This does not provide a full opening of the gusset at the top of the bag.

SUMMARY OF THE INVENTION

In accordance with the present invention, a reclosable package is provided. The package includes opposing walls extending from a package bottom, which walls are joined at opposite sides of the package by two expanding side gussets.

The package further includes a reclosable zipper attached to the package walls. The reclosable zipper is comprised of a pair of complementary interlocking fastener profiles carried by a carrier web. The carrier web includes two opposing walls joined at their ends by a pair of opposing gussets that extend beyond the ends of the fastener profile. The fastener profiles are attached to opposing inner wall surfaces of the carrier web and the carrier web is thin enough in the gusset area so that when the fastener profiles are interlocked, the carrier web gussets are caught between the fastener profiles.

The present invention will now be described in detail, with frequent reference being made to the drawings identified below in which identical numerals represent identical elements.

DETAILED DESCRIPTION OF THE PREFERRED EMBODIMENT

Figure 8:
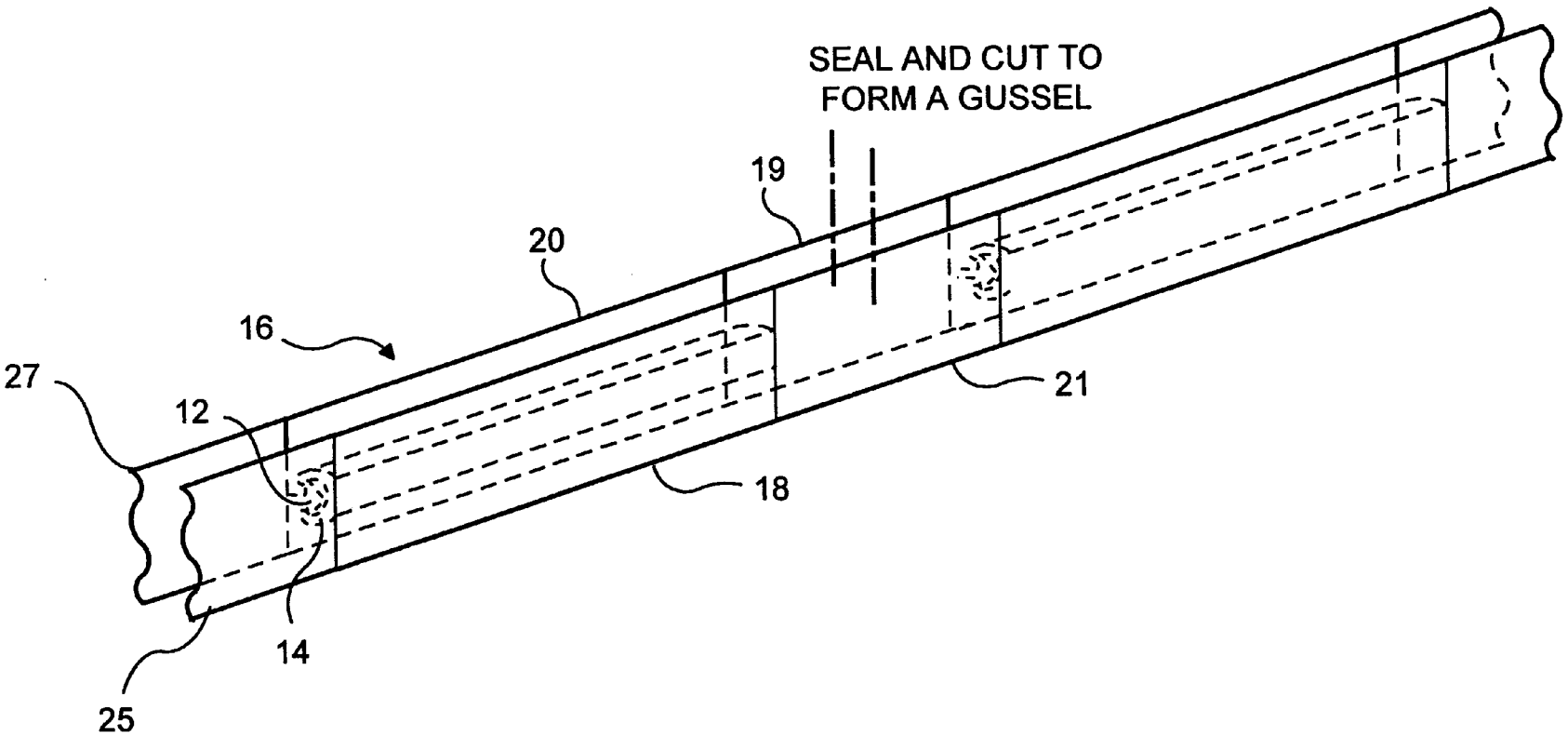
FIG. 8 is a perspective view of a zipper carrier tape from which the zipper of FIG. 1 is found.

In accordance with the present invention, a reclosable zipper 10 is shown in FIG. 8. The zipper 10 includes a first fastener profile 12 and a complementary second fastener profile 14, both carried by a carrier web 16. The profiles 12, 14 are releasably interlockable and may have any configuration which allows for their releasable engagement. The walls 25, 27 of carrier web 16 sufficiently thin so as to enable the profiles 12, 14 to engage even when a double ply is caught therebetween. In FIG. 8, the first fastener profile 12 has an asymmetrical arrow-shaped cross-section and the second fastener profile 14 has a U-shaped cross-section. The fastener profiles are formed from any one of many suitable plastics well-known to those of ordinary skill in the reclosable packaging art.

Figure 1:
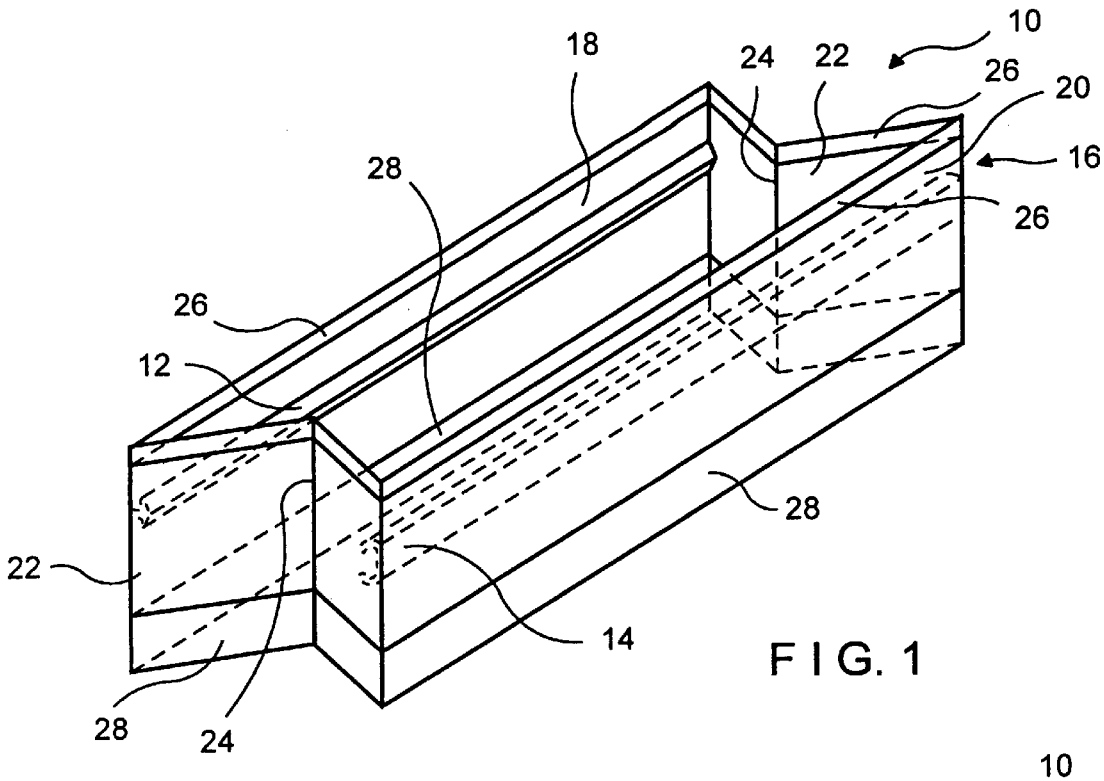
FIG. 1 is a perspective view of a reclosable zipper in accordance with the present invention opened.
Figure 2:
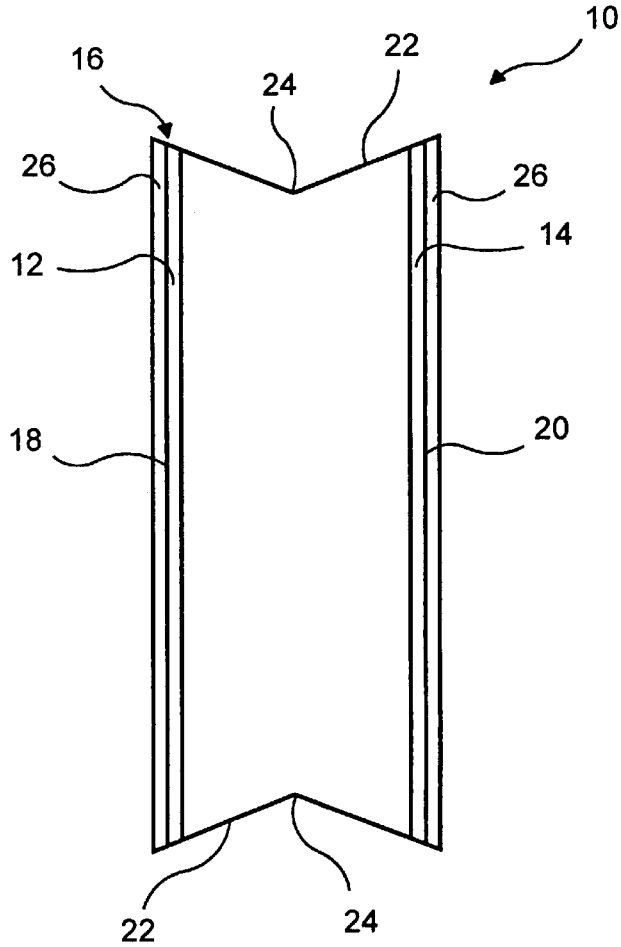
FIG. 2 is a plan view of the reclosable zipper of FIG. 1.

As shown in FIG. 8, the carrier web 16 includes a carrier web sections 25, 27 to which lengths of mating profiles 12, 14 are intermittently fixed to define profile free areas 21, 23 between profile bearing wall areas 18, 20. The profile free areas 21, 23 on opposed sides of each length of profiles bearing walls 18, 20 are slit and joined together so as to form a pair of opposing gussets 22. That is, as shown in FIGS. 1 and 2, with the zipper profiles unengaged, the zipper web 16 assumes a band-shape defined by the pair of profile bearing opposing walls 18, 20 connected at their ends by the pair of gussets 22, each defined by joined lengths of profile free carrier web sections. The profile bearing walls 18, 20 have a length substantially equal to the width of the package to which the zipper 10 will be attached and the gussets 22 have a length when expanded substantially equal to the length of the expanded gussets on the package to which the zipper 10 will be attached so that each profile free area 21, 23 of carrier web 16 is twice that length.

Figure 3:
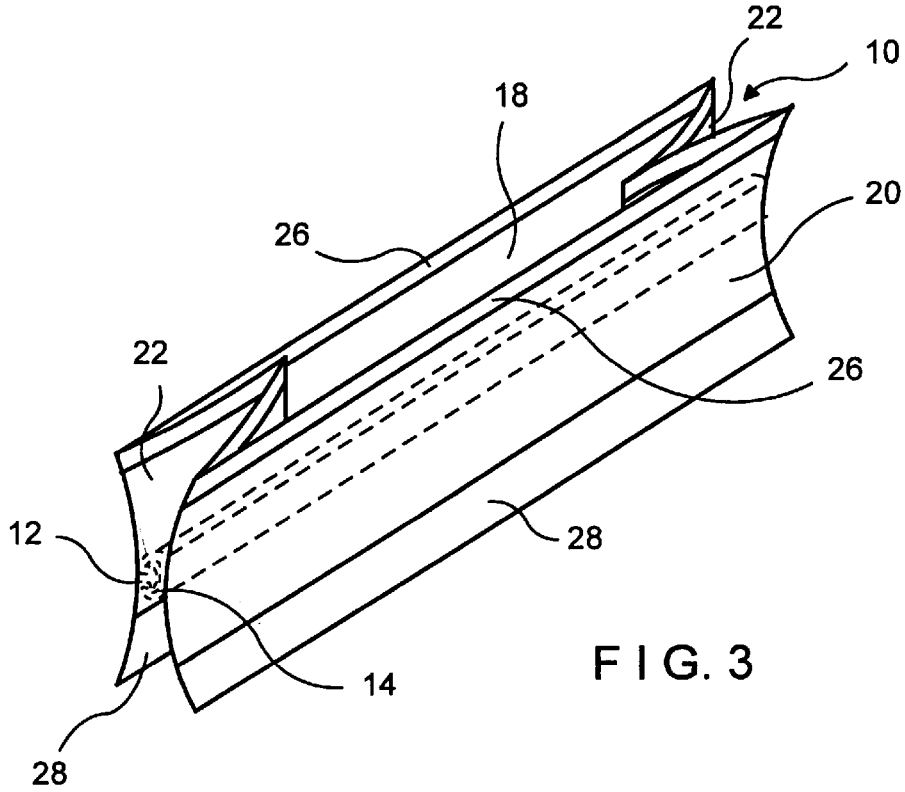
FIG. 3 is a perspective view of the reclosable zipper of FIG. 1 closed.
Figure 4:
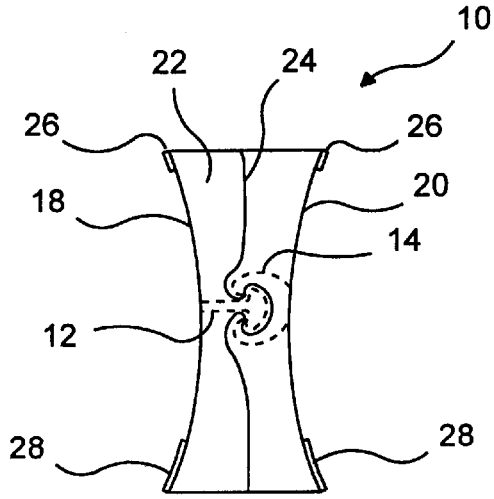
FIG. 4 is an end view of the reclosable zipper of FIG. 3.

As shown in FIGS. 3 and 4, when the fastener profiles 12, 14 are interlocked, the gussets 22 of the carrier web 16 are captured between the fastener profiles 12, 14, forming a gasket. The carrier web 16 is constructed so that it is thin enough to facilitate its capture between the fastener profiles.

The carrier web 16 additionally includes a reinforcing rib 26 at its top to provide stiffness. Optionally, the carrier web 16 may also include a band 28 at its bottom to provide additional reinforcement as well as to prevent seal through if the zipper 10 is to be heat sealed to the inside walls of a package. If the zipper is to be attached to the outside walls of a package, the band 28 may instead be formed from a suitable adhesive well-known to those of ordinary skill in the reclosable packaging art.

Figure 5:
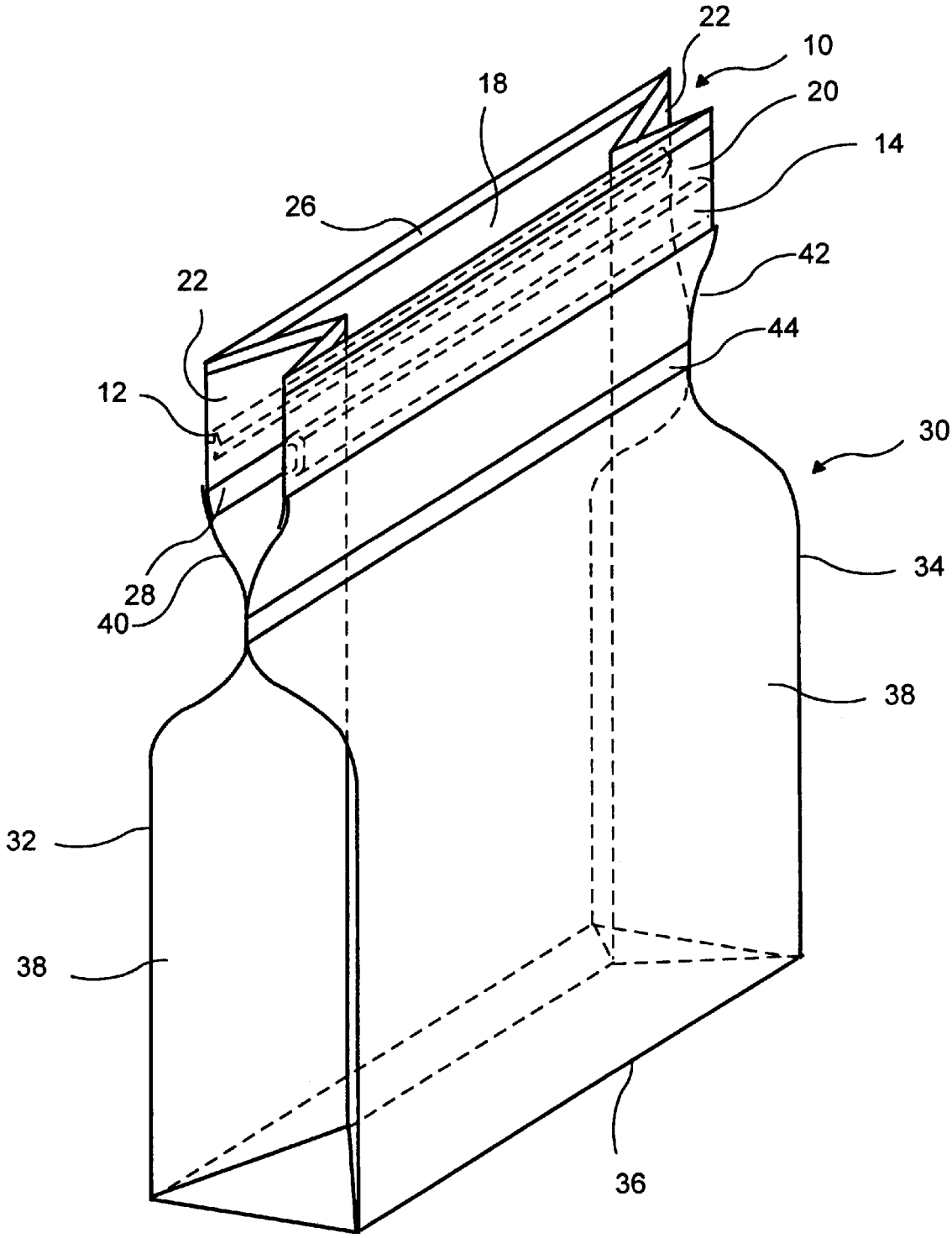
FIG. 5 is a perspective view of a reclosable package in accordance with one embodiment of the present invention.

FIG. 5 shows a reclosable package 30 in accordance with one embodiment of the present invention. The package 30 includes first and second walls 32, 34 extending upwardly from a bottom 36. The walls 32, 34 are joined together at opposite sides of the package by a pair of expanding side gussets 38. The first and second walls 32, 34 each further include opposing free end portions 40, 42 also joined by the expanding side gussets 38.

As shown in FIG. 5, the zipper 10 is positioned between the opposing free end portions 40, 42 and gussets 38 with the walls 18, 20 of the carrier web 16 being sealed thereto and the carrier gusset 22 being sealed to the gussets 38. Preferably, the zipper 10 is heat sealed to the opposing free end portions 40, 42 and gussets 38, although the zipper 10 may be attached thereto by means of an adhesive. In the former case, the carrier web band 28 acts as an additional reinforcing rib and seal through prevention and in the latter case the carrier web band 28 is itself the adhesive.

The package 30 optionally further includes a peel seal 44 which joins the opposing free end portions 40, 42 and gussets 38. To open the package 30, the user simply disengages the fastener profiles 12, 14 and opens the peel seal 44.

To avoid clutter, the reinforcing rib 26 and bond 28 are not show in FIG. 8 but obviously must be there in the positions shown in FIGS. 4 and 5.

Figure 6:
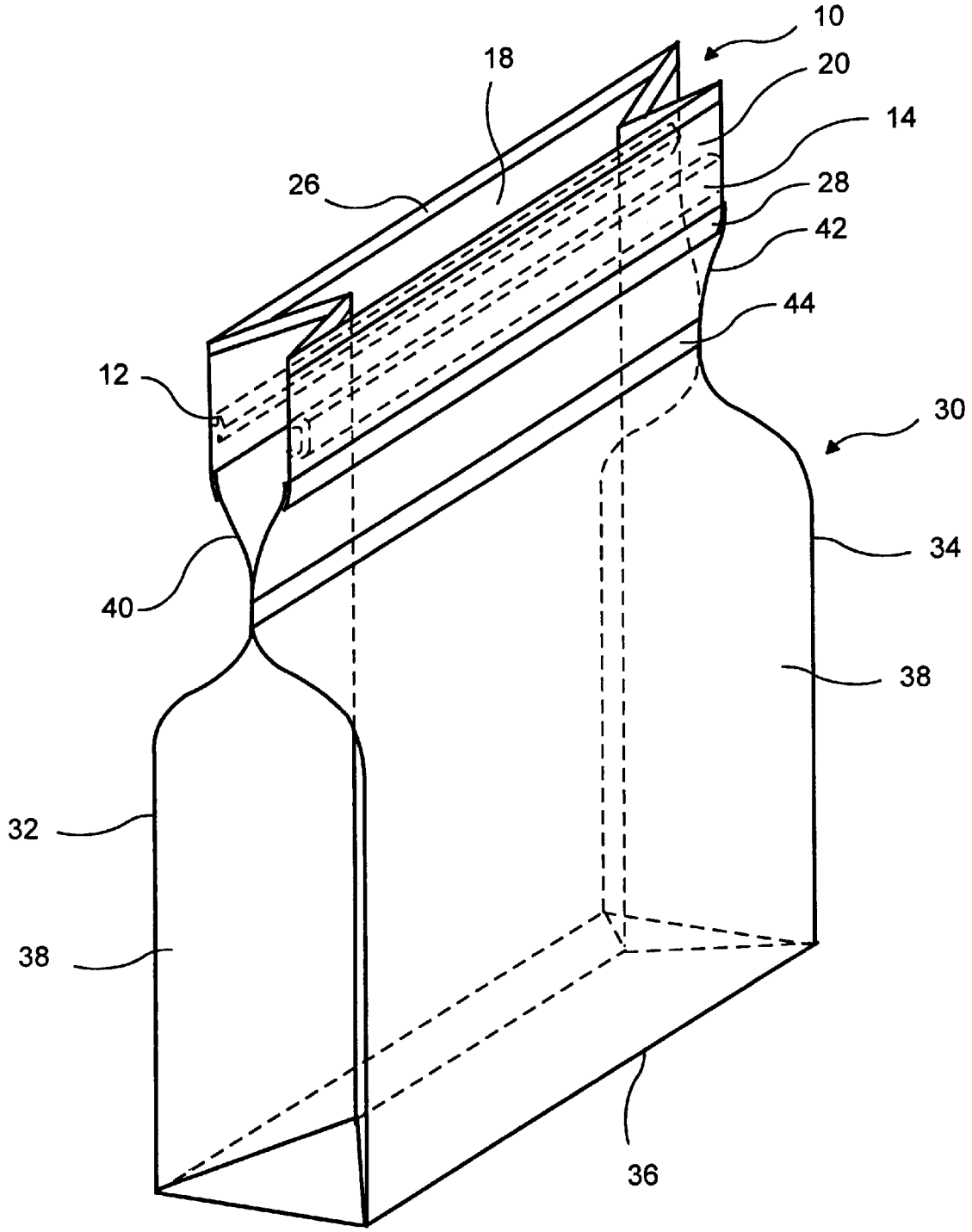
FIG. 6 is a perspective view of a reclosable package in accordance with another embodiment of the present invention.

FIG. 6 shows a reclosable package in accordance with another embodiment of the present invention. In this case, the carrier web walls 18, 20 are attached to the outer surfaces of the free end portions 40, 42, rather than the inner surfaces as shown in FIG. 5. The carrier web band 28 is formed from an adhesive to facilitate attachment.

Figure 7:
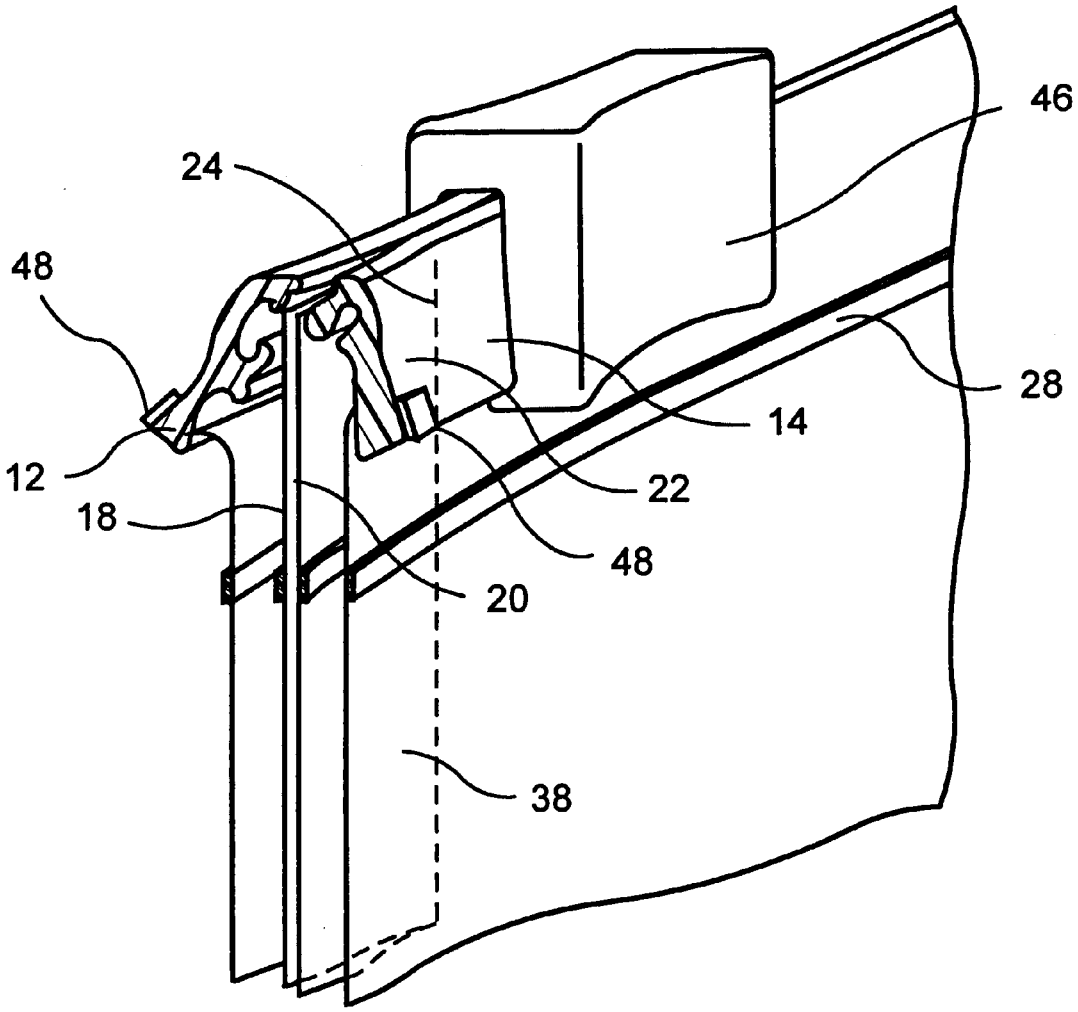
FIG. 7 is a perspective view of a section of a reclosable package having a slide-zipper in accordance with yet another embodiment of the present invention.

Optionally, a slider 46 may be included for opening and closing of the fastener profiles 12, 14, as shown in FIG. 7. In that case, the fastener profiles 12, 14 must be specially configured to cooperate with such a slider so that the slider opens the zipper as it is moved along the fastener profiles in an opening direction towards an opened end of the zipper and closes the zipper as it is moved along the fastener profiles in a closing direction towards a closed end of the zipper. Additionally, the slider must be configured so that the gussets 22, when folded, do not interfere with the operation of the slider. Thus, a slider which makes use of a separating finger would be unsuitable. The slider 46 shown in FIG. 7 opens the zipper by pivoting the specially configured profiles out of engagement. Because the slider 46 does not have a separating finger, the folded gussets 22 pass between the slider legs unobstructed. However, it is evident from FIG. 7 that when a slider is used the gusset 22 at the opened end of the zipper will always be folded, even when the zipper is opened. However, this should provide little or no interference with the expansion of the package gussets 38, especially towards the bottom of the package. The fastener profiles 12, 14 can be attached to either the inside or outside surfaces of the carrier web walls 18, 20. End stops 48 are provided on the fastener profiles to prevent the slider from sliding off the ends of the zipper.

Thus, in the foregoing manner the object of the present invention is achieved. Modifications to the above would be obvious to those of ordinary skill in the art, but would not bring the invention so modified beyond the scope of the appended claims.

We claim:

1. A reclosable zipper assembly comprising:

a carrier web including a pair of opposing walls joined at their ends by a pair of opposing inwardly directed gussets;

a first profile coextensive with a first of said opposing walls; and a second profile coextensive with a second of said opposing walls;

said first and second profiles being engageable with each other in an interlocking fit over their entire lengths and disengageable over their entire lengths;

wherein said carrier web is sufficiently thin and positioned to enable said gussets to be captured between said first and second profiles when said profiles engage in an interlocking fit and said gussets being free to fully expand when said profiles are disengaged.

2. The reclosable zipper according to claim 1 wherein said carrier web includes at least one reinforcing rib substantially parallel to said first and second fastener profiles.

3. The reclosable zipper according to claim 1 wherein said carrier web includes a band of adhesive substantially parallel to said first and second fastener profiles.

4. The reclosable zipper according to claim 1 further including a slider disposed on said fastener profiles, said slider being adapted to open and close said zipper as said slider is moved along said fastener profiles in opening and closing directions, respectively.

5. The reclosable zipper according to claim 2 wherein said at least one reinforcing rib is above said first and second profiles.

6. The reclosable zipper according to claim 2 wherein said at least one reinforcing rib is below said first and second profiles.

7. A reclosable package comprising:

a bottom;

a first wall extending from said package bottom;

a second wall extending from said package bottom opposite to said first wall;

a pair of opposing expanding side gussets joining said first and second walls; and a reclosable zipper attached to said first and second package walls, said reclosable zipper including a carrier web, said carrier web including opposing first and second walls joined at their ends by opposing first and second zipper gussets; a first fastener profile; and a second fastener profile engageable in an interlocking fit with said first fastener profile and disengageable from said first fastener profile over the entire length of said fastener profiles, said first and second fastener profiles being [attached to and]coextensive respectively with said first and second carrier web walls, said carrier web being sufficiently thin and positioned to allow said first and second carrier web gussets to be captured between said first and second fastener profiles when said profiles engage in an interlocking fit and said gussets being free to fully expand when said profiles are disengaged.

8. The reclosable package according to claim 7:

wherein said first and second walls and expanding gussets each include free end portions; and wherein said carrier web is attached to said free end portions.

9. The reclosable package according to claim 7 wherein said carrier web is attached to inner surfaces of said free end portions.

10. The reclosable package according to claim 8 wherein said carrier web is attached to outer surfaces of said free end portions.

11. The reclosable package according to claim 8 wherein said free end portions and expanding gussets are joined together by a peel seal.

12. The reclosable package according to claim 7 further including a slider disposed on said fastener profiles, said slider being adapted to open and close said zipper as said slider is moved along said fastener profiles in opening and closing directions, respectively.

13. A carrier web comprising:

intermittent lengths of opposing profile bearing walls, a first of said opposing walls having a first profile attached thereto and a second of said walls having a second profile, engageable with said first profile in an interlocking fit attached thereto, said first and second profiles being engageable and diengageable over their entire lengths; and, opposing profile free wall lengths interposed between said profile bearing walls; said profile free walls being sufficiently thin and positioned to be capturable between said first and second profiles when said first and second profiles are engaged in an interlocking fit and said profile free walls being free to fully expand when said profiles are disengaged.

14. The carrier web in accordance with claim 13 further comprising at least one reinforcing rib substantially parallel to said first and second fastener profiles extending along said profile bearing and profile free wall lengths.

15. The carrier web in accordance with claim 14 wherein said reinforcing rib is above said fastener profiles.

16. The carrier web in accordance with claim 14 wherein said reinforcing rib is below said fastener profiles.

17. The carrier web in accordance with claim 14 further comprising a band of adhesive substantially parallel to said first and second fastener profiles.

18. A method of forming a gusseted reclosable package comprising the step of:

forming a gusseted package having a pair of opposing first and second walls and a pair of expanding gussets joining said first and second walls;

attaching to a top portion of each of said first and second walls one of a first and second mating profile of a reclosable zipper, said mating portions being disengageable and engageable with each other in an interlocking fit over their entire lengths and carried on a carrier web; and attaching to said package gussets, a gusseted, profile free portion of said carrier web, said gusseted profile free portion of said carrier web being sufficiently thin and positioned to be captured between said first and second mating profiles when said mating profiles engage in an interlocking fit and said attaching permitting said gussets to fully expand when said profiles are disengaged.

* * * * *